US006185870B1

(12) United States Patent
Mettler

(10) Patent No.: US 6,185,870 B1
(45) Date of Patent: Feb. 13, 2001

(54) ADJUSTABLE THRESHOLD ASSEMBLY

(75) Inventor: Charles Mettler, Perry, OH (US)

(73) Assignee: Stafast Products, Inc., Parnesville, OH (US)

( * ) Notice: Under 35 U.S.C. 154(b), the term of this patent shall be extended for 0 days.

(21) Appl. No.: 09/369,363

(22) Filed: Aug. 6, 1999

(51) Int. Cl.[7] ..... E06B 1/70

(52) U.S. Cl. ..... 49/468; 49/469; 52/204.51; 411/43; 411/183

(58) Field of Search ..... 49/467, 468; 411/107, 411/180, 183, 43, 45, 49; 52/204.51

(56) References Cited

U.S. PATENT DOCUMENTS

| | | | | |
|---|---|---|---|---|
| 3,235,917 | * | 2/1966 | Skubic | 49/468 |
| 4,352,258 | * | 10/1982 | Bursk et al. | 49/468 |
| 4,913,609 | * | 4/1990 | Mauer | 411/107 |
| 5,010,690 | | 4/1991 | Geoffrey . | |
| 5,230,181 | | 7/1993 | Geoffrey et al. . | |
| 5,517,788 | | 5/1996 | McGough et al. . | |
| 5,524,391 | | 6/1996 | Joffe et al. . | |
| 5,618,144 | * | 4/1997 | Leistner | 411/427 |
| 5,638,641 | | 6/1997 | Joffe et al. . | |

* cited by examiner

*Primary Examiner*—Daniel P. Stodola
*Assistant Examiner*—Curtis A. Cohen
(74) *Attorney, Agent, or Firm*—Woodling Krost & Rust

(57) ABSTRACT

A one-piece wood rivet having a first upper portion and a second lower portion is disclosed for use in adjustably securing a first piece of wood to a second piece of wood. A typical application of the rivet is the adjustment of a door threshold assembly. The first upper portion of the one-piece wood rivet includes a head and a flange. The second lower portion of the one-piece wood rivet includes a threaded shank which mates with a nut affixed to the second piece of wood. The head of the first upper portion of the one-piece wood rivet includes a lip which is deformable into a countersunk bore in the first piece of wood. The one-piece wood rivet resides substantially in a bore which extends through the first piece of wood. The one piece wood rivet is rotatable within the bore of the first piece of wood and is secured to the first piece of wood by its flange and the deformed lip. The second piece of wood includes a bore therethrough and a nut having threads affixed to the second piece of wood. The threads of the wood rivet mate with the threads of the nut. The first and second piece of wood are adjustably separated from each other by a distance determined by the extent of the threading between the rivet and the nut.

10 Claims, 7 Drawing Sheets

ADJUSTABLE THRESHOLD ASSEMBLY

FIELD OF THE INVENTION

The invention is in the field of adjustable threshold assemblies for use in a doorways. A cap strip is adjustable with respect to a wood base. The adjustment accommodates the fit of the door which is hung immediately adjacent to and above the cap strip. Adjustments are necessitated because the material dimensions and manufacturing tolerances vary. Settling of structures in which the doors are used is also common which changes the position of the door relative to the cap strip thus necessitating adjustment. The invention is a one-piece wood rivet which is affixed to the cap strip such that the rivet may rotate allowing threads on the rivet to mate with threads in a t-nut. A space between the cap strip and the wood base is thus controlled by the degree of mating between the wood rivet and the t-nut.

BACKGROUND OF THE INVENTION

U.S. Pat. No. 5,517,788 to McGough et al., U.S. Pat. No. 5,638,641 to Joffe et al., U.S. Pat. No. 5,524,391 to Joffe, et al., and U.S. Pat. No. 5,010,690 to Geoffrey disclose wood cap strips, sometimes referred to as rail members, in conjunction with wood base members. Each of these patents discloses structure which accomplishes an adjustment in the distance between the wood cap strip and the wood base member. Each of these patents employ a two piece screw assembly which is pressed together. Other two-piece designs exist and are essentially a screw which passes through the cap strip and threadingly engages a washer which acts as a flange. U.S. Pat. No. 5,230,181 to Geoffrey et al. discloses a one piece screw which resides in a slot in a rail member made of aluminum.

There has long been a need for an adjustable threshold wherein two pieces of wood are adjustably and securely positioned with respect to each other. The one-piece wood rivet of the invention is deformed and securely fastens the wood rivet to the cap strip while permitting rotation of the wood rivet relative to the cap strip. The related art employs two-piece screws which may become separated or loose. Additionally, the fit of the two piece screws sometimes leaves a gap between the flange and the bottom of the cap strip. This gap creates play which results in the cap strip being slightly depressed when a person steps on it. This may, after time, result in permanent deformation of the strip which negates the intended adjustable feature of the cap strip. More importantly, however, the fit of the door relative to the cap strip is compromised.

The one-piece wood rivet of the instant invention is securely deformed into the wood cap strip while capturing the wood cap strip between the flange and the head of the wood rivet. Similarly, the one-piece wood rivet of the instant invention may be deformed into material other than wood. It is envisioned that the rivet of the instant invention may be made from many different materials so that it may be used with substrates of all types. By substrates it is meant wood, plastic or polymeric material and/or metals.

SUMMARY OF THE INVENTION

A one-piece rivet comprising a first upper portion and a second lower portion is disclosed. The first upper portion includes a flange and a head. The head of the upper portion includes a lip. Threads are located on the exterior of the second lower portion. The head of the upper portion of the rivet includes at least one groove for receiving a screw driver. A Phillips head screw driver is typically used and the head necessarily contains two grooves. The one-piece rivet is typically used in conjunction with a wood cap strip or other substrate having a countersunk bore therein. The principal bore extends through the wood piece or other substrate. The countersunk bore is generally a truncated and inverted conical shape which is filled by the head of the upper portion of the rivet when it is deformed by an orbital riveter. The deformation process results in the head of the rivet being shoved into and slightly compressing the wood cap strip but not so much as to prohibit the rotation of the rivet under the urging of a screw driver. Typically, the screw driver will be mechanically driven as the cap strip is preliminarily adjusted during assembly at the factory prior to being shipped to the construction site. At the construction site the cap strip is adjusted again relative to the wood base member and the door.

A process for adjustably securing a first piece of wood relative to a second piece of wood is disclosed using a one-piece wood rivet having a head, a flange and threads on the exterior thereof and a nut comprising the steps of: boring a first diameter hole into and through said first piece of wood; countersinking a second diameter hole in said first piece of wood; inserting said one-piece wood rivet into said first diameter hole in said first piece of wood until said flange of said rivet abuts said first piece of wood; deforming said head of said one-piece wood rivet such that said head occupies said countersunk bore; boring a hole into and through said second piece of wood; affixing a nut capable of receiving said threads of said wood rivet into said hole of said second piece of wood; and, threading said threads of said rivet into said nut adjustably securing said first piece of wood relative to said second piece of wood. Instead of using wood, some other substrate could be used such as plastic or metal.

It is an object of the present invention to provide a rivet which is securely fastened to a first substrate while still permitting the rivet to rotate with respect to the first substrate. The rivet rotates under the urging of a tool such as a screw driver.

It is an object of the present invention to provide a wood base member which includes a t-nut mounted in a bore and which has a strip affixed thereto. The t-nut includes interior threads which coact with threads on the lower (shank) portion of the rivet.

It is an object of the present invention to provide a rivet whose flange engages one side of a substrate and whose head is deformed so as to engage a countersunk bore in the opposite side of the substrate while still permitting the rivet to rotate with respect to the first substrate.

It is an object of the present invention to provide a plurality of rivets which are securely fastened to a first substrate and which engage a respective plurality of t-nuts so as to control the spacing between the first and second substrates.

It is an object of the present invention to provide a wood rivet which is secure to the substrate, be it wood or some other material, such that there is no translational (axial) movement of the rivet with respect to the first substrate.

It is an object of the present invention to provide a t-nut having a flared mouth for receiving a threaded shank or lower portion of the rivet.

The drawings will be better understood when taken in conjunction with the Description Of The Invention and the Claims which follow hereinbelow.

DESCRIPTION OF THE INVENTION

Figure 1:
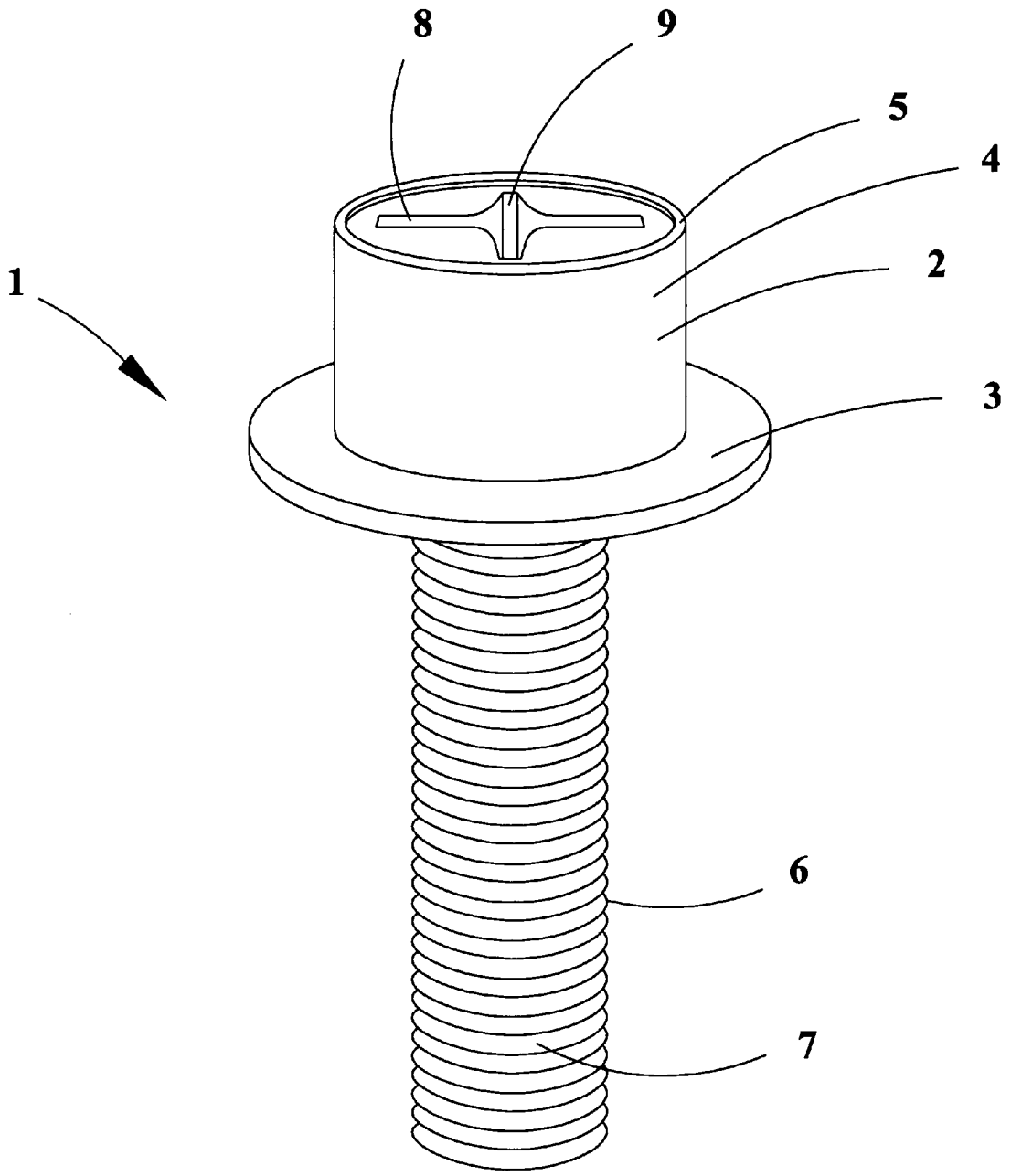
FIG. 1 is a perspective view of the wood rivet.

FIG. 1 is a perspective view of the wood rivet. Reference numeral 1 denotes the wood rivet which is comprised of an upper portion 2 and a lower portion 6. Upper portion 2 includes a head 4 having a lip 5. Flange 3 is circumferentially disposed about the upper portion 2 of the rivet 1. Lower portion 6 includes threads 7 thereon. A first groove 8 and a second groove 9 are in the head 4 and are adapted to engage a screwdriver, either a flathead screwdriver or a Phillips head.

Figure 2:
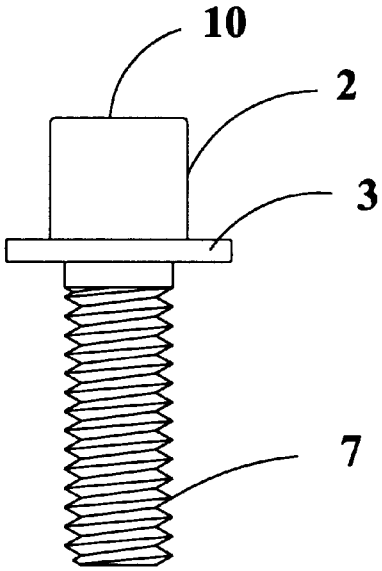
FIG. 2 is a front view of the wood rivet.
Figure 3:
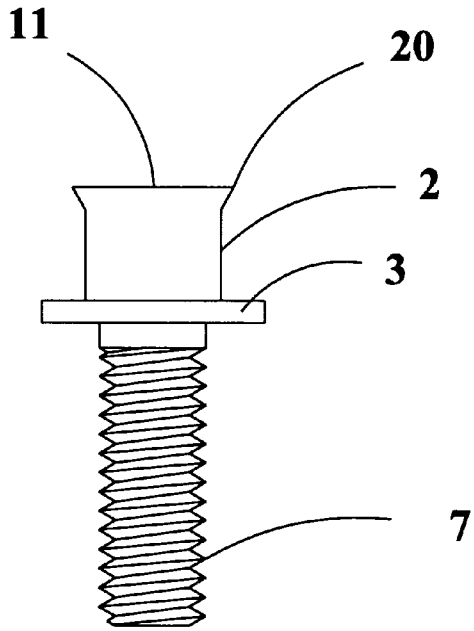
FIG. 3 is a front view of the wood rivet with the lip of the head deformed.

FIG. 2 is a front view of the wood rivet. Reference numeral 10 denotes the diameter of the cylindrical upper portion 2 of the rivet 1. FIG. 3 is a front view of the wood rivet with the lip 5 of the head 4 deformed. Reference numeral 11 represents the diameter of the upper portion 2 of the rivet 1 after deformation thereof by an orbital riveter. Those skilled in the art will readily recognize that the lip 5 of the head may be deformed by any one of a plurality of methods and/or equipment with an orbital riveter being just one of such methods.

Figure 4:
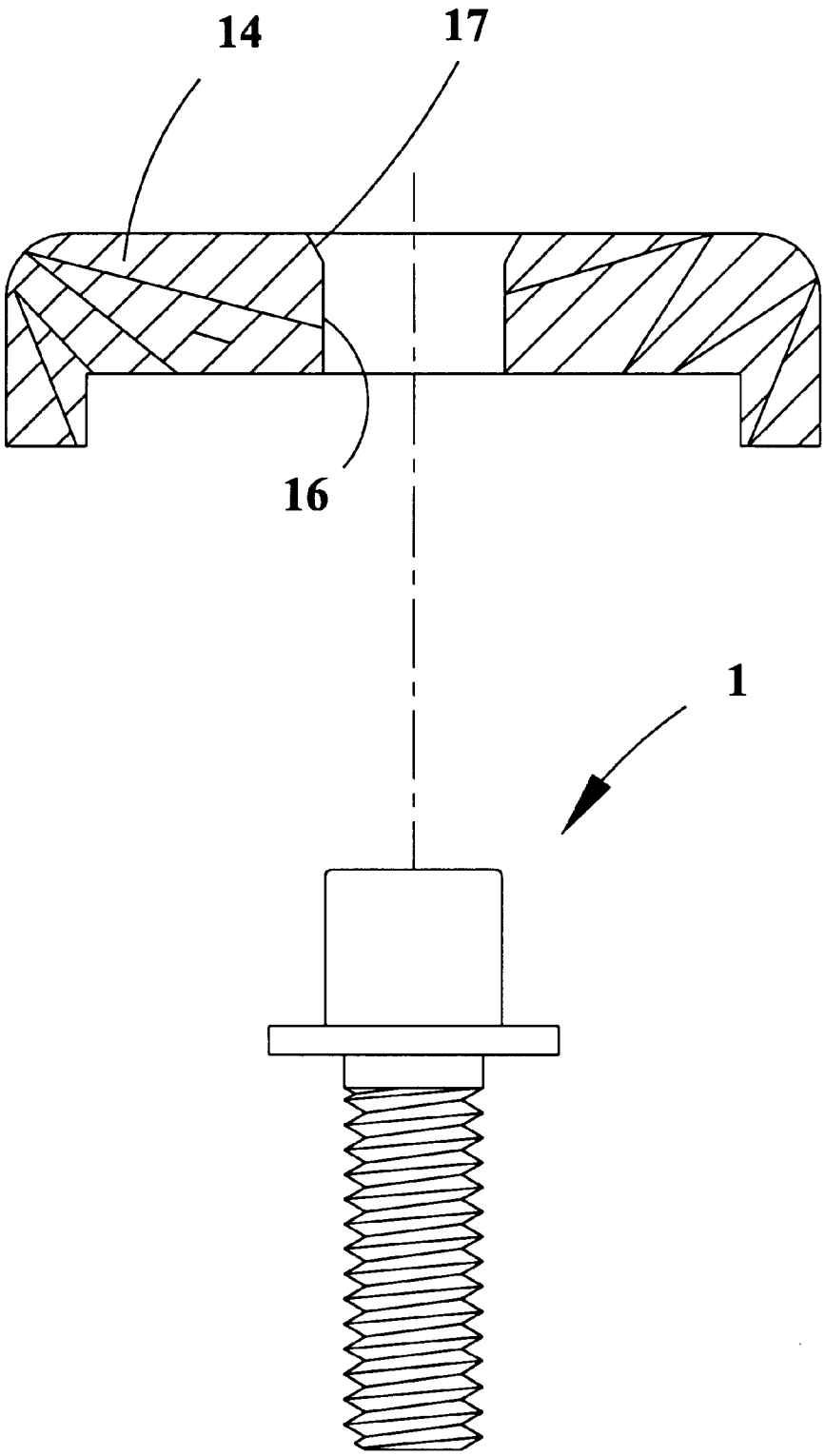
FIG. 4 is an exploded view, partly in cross-section, of the first piece of wood and the wood rivet.

FIG. 4 is an exploded view, partly in cross-section, of the first piece of wood 14 and the wood rivet 1. Reference numeral 16 represents the first diameter bore in the first piece of wood 14. Countersunk bore 17 is generally in the shape of an inverted cone which has been partially truncated. Sometimes this is referred to as a frustum of a cone.

Figure 5:
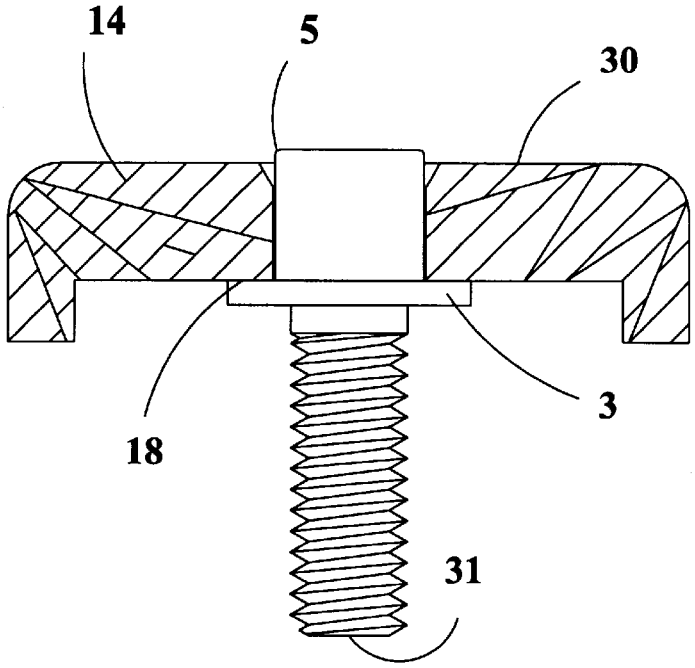
FIG. 5 illustrates the first piece of wood in cross-section and the wood rivet in a first bore of the first piece of wood.

FIG. 5 illustrates the first piece of wood 14 in cross-section and the wood rivet 1 in the first bore of the first piece of wood 14. Flange 3 abuts the bottom side of the first piece of wood 14 as is indicated by reference numeral 18. Lip 5 protrudes slightly above the top or upper surface 30 of the first piece of wood 14. FIG. 5 illustrates the insertion of the wood rivet 1 into the first piece of wood 14 (sometimes called the cap strip or the rail member in the art) prior to deformation of the head and the lip with the orbital riveter. The orbital riveter deforms each of the wood rivets in the cap strip. Varying numbers of wood rivets may be used depending on the type of cap strip or customer preference. Reference numeral 31 indicates the point of abutment of lower portion 6 against a firm support during the orbital riveting process. During orbital riveting the diameter and hence radius of the head 4 of the upper portion 2 of the wood rivet 1 is enlarged.

Figure 6:
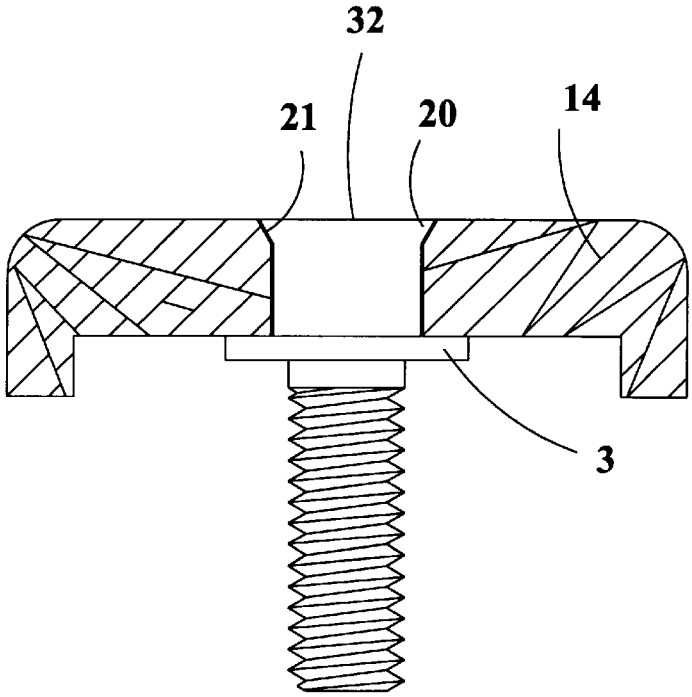
FIG. 6 illustrates the first piece of wood in cross-section and the wood rivet with a deformed lip filling the countersunk bore.

FIG. 6 illustrates the first piece of wood 14 in cross-section and the wood rivet with a deformed lip 20 filling the countersunk bore 17. In actual practice there will be a plurality of wood rivets installed in the cap strip. Reference numeral 20 represents the deformed lip 5 which is expanded radially into and against countersunk bore 17. As the lip 5 is deformed into what is called herein the deformed lip 20, it is also flattened to a degree such that it is approximately on the same plane as the upper or top surface 30 of the first piece of wood 14. During orbital riveting the head and lip of the wood rivet may be deformed to the point where the upper surface 32 is slightly concave. During deformation, the head of the rivet may slightly compress the material of the substrate and reference numeral 21 is used to indicate the abutment of the head against and sometimes into the substrate. The compression, however, is not so significant so as to impede the rotation of the wood rivet under the influence of a screw driver.

This structure provides a tight fitting wood rivet in that the wood rivet does not have any translational movement. By this it is meant that the wood rivet does not move vertically (axially) upwardly and downwardly when viewing FIG. 6. It is fastened to the wood piece by the deformed head and the flange 3.

Sometimes herein the term substrate is used to denote another unspecified material such as metal, plastic or polymeric materials. Further, it is contemplated that the substrate could be any other engineered material such as plywood, particle board or wafer board covered with a veneer. The material of the wood rivet is preferably steel but other materials such as plastic may be used.

Figure 7:
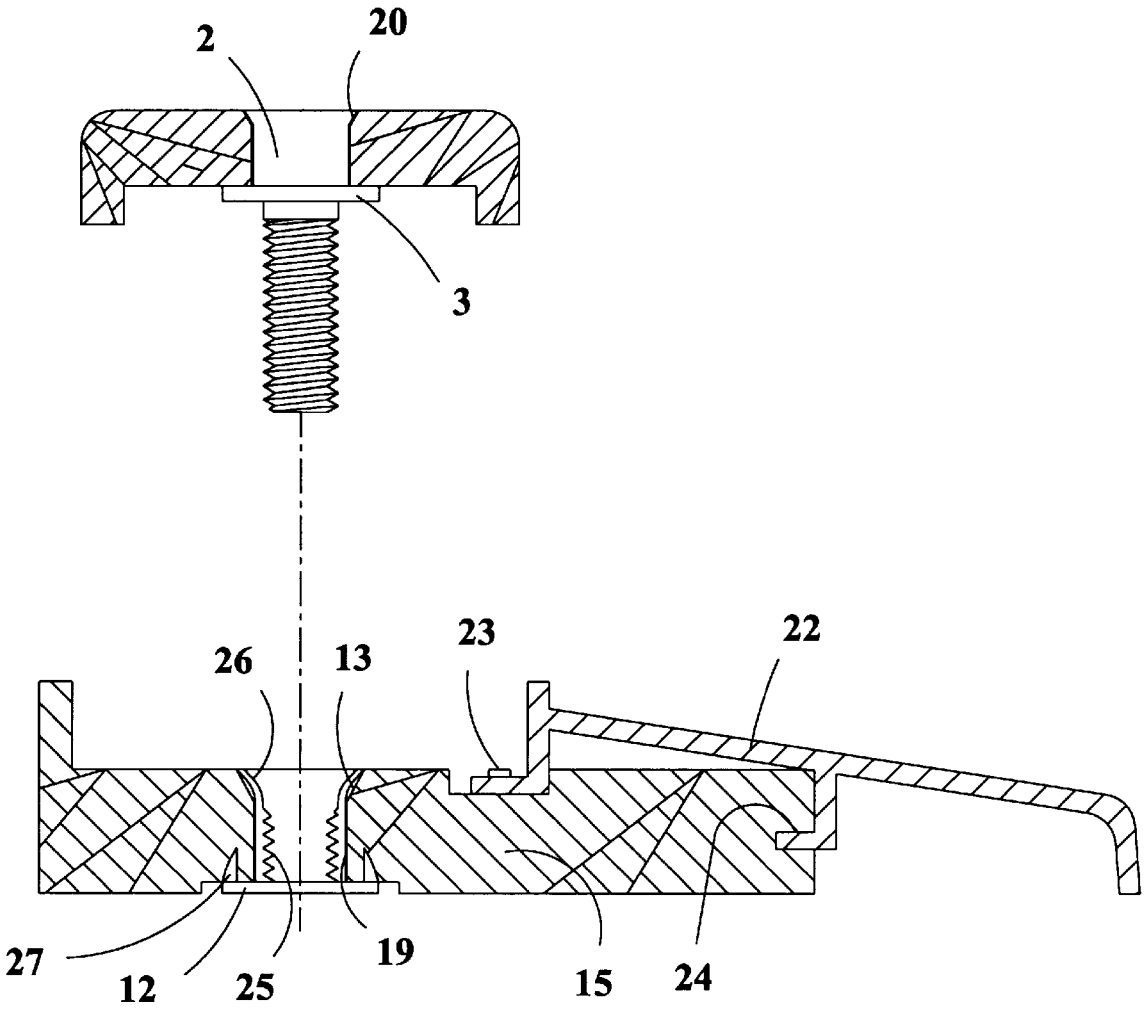
FIG. 7 is an exploded view of the wood rivet rotatably mounted in the first piece of wood and the second piece of wood, t-nut and strip.

FIG. 7 is an exploded view of the wood rivet rotatably mounted in the first piece of wood 14, the second piece of wood 15, t-nut 12 and sill 22. Sill 22 is typically made of aluminum and it is inserted in recess 24 of the second piece of wood 15 and is affixed to the second piece of wood by screw 23. T-nut 12 includes threads 25 and a flared mouth or opening 26. Second piece of wood 15 includes a bore 19 therethrough and countersunk bore 13. Once the bore 19 and countersunk bore 13 have been made in the second piece of wood, the t-nut is pressed into the second wood piece 15. Sharp protrusions or teeth 27 of the t-nut hold the t-nut from rotation within the bore 19. The t-nut's mouth 26 is flared to engage the countersunk bore 13 of the second piece of wood. This helps to fasten the t-nut 12 against any translational (axial) movement in the vertical direction. The flared mouth 26 assists in accommodating misalignment between the threaded wood rivet 1 and the t-nut.

Figure 8:
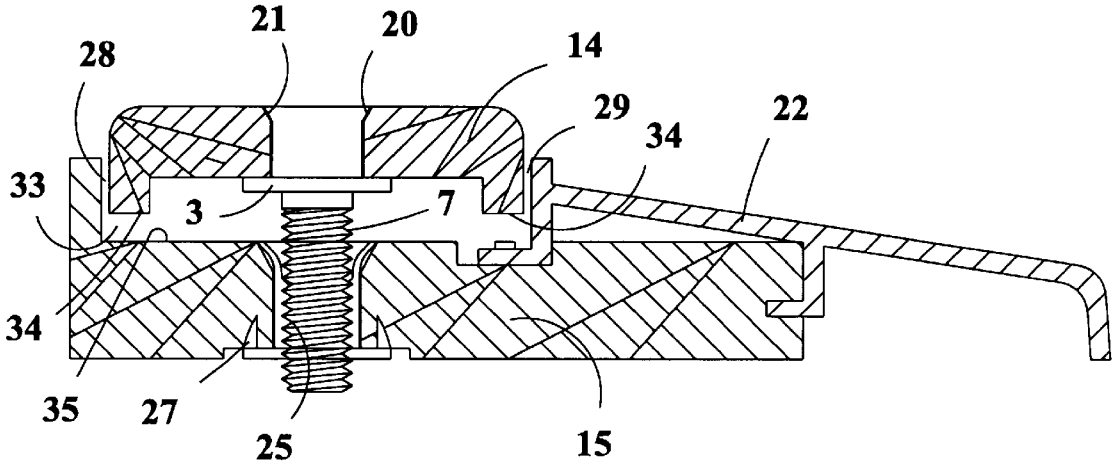
FIG. 8 is a cross-sectional view of the first piece of wood affixed to the second piece of wood.

FIG. 8 is a cross-sectional view of the first piece of wood 14 affixed to the second piece of wood 15. Reference numeral 28 represents a gap or clearance between the first piece of wood and the second piece of wood. Reference numeral 29 represents a gap between the first piece of wood and the sill 22. Reference numeral 33 represents a gap between the shoulders 34 of the cap strip and the top 35 of the second piece of wood 15. The gap 33 is controlled by the relative threading between the threads 7 on the exterior portion of the of the wood rivet and the threads 25 on the t-nut. It will be understood by those skilled in the art that the second piece of wood is affixed to the door frame. Further, it will be understood by those skilled in the art that the relative dimensions of the members may change without departing from the spirit and scope of the appended claims.

Figure 9:
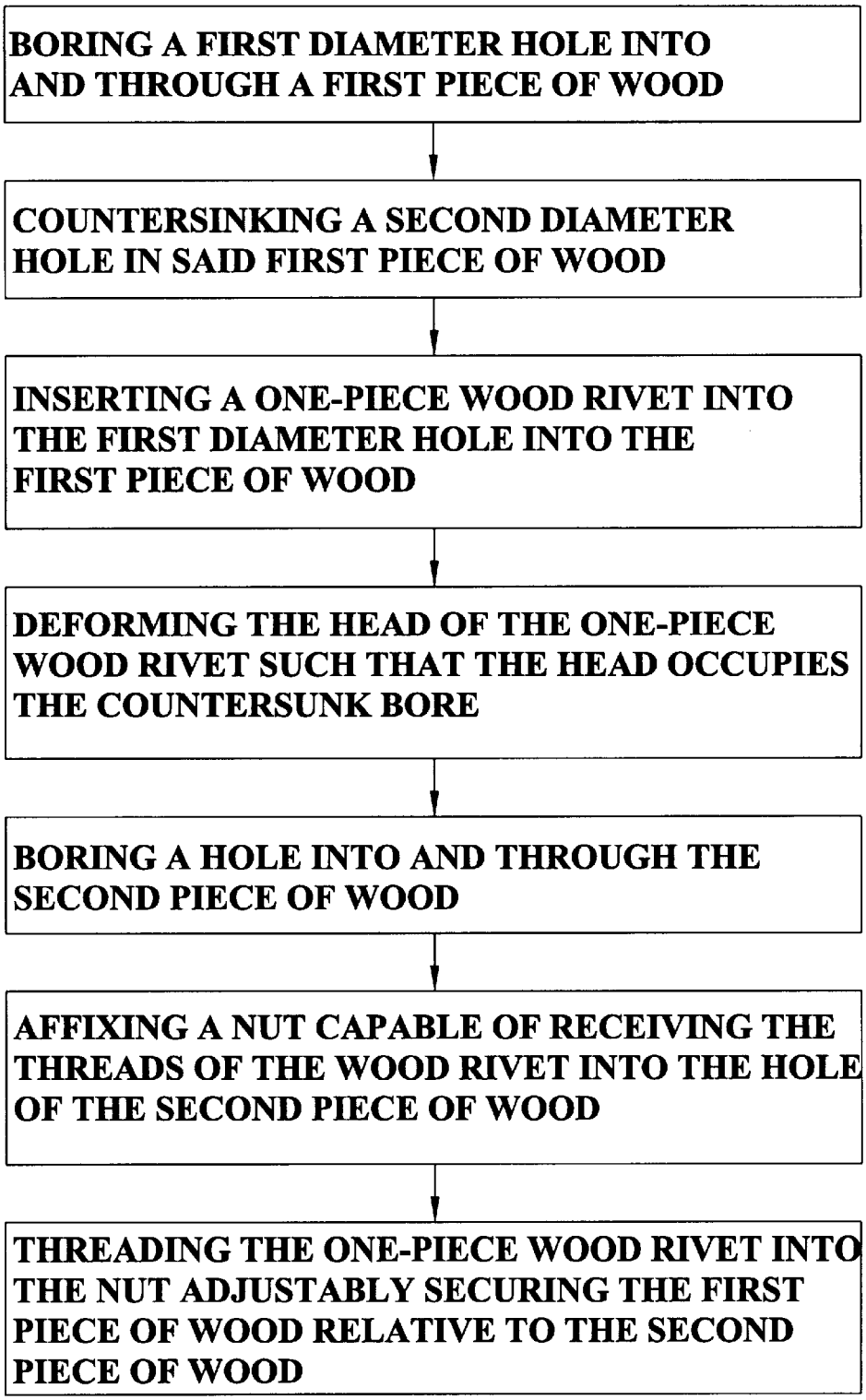
FIG. 9 is a diagram of the method of using the wood rivet to affix the first piece of wood to the second piece of wood.

FIG. 9 is a diagram of the method of using the wood rivet to affix the first piece of wood to the second piece of wood comprising the steps of boring a first diameter hole into and through a first piece of wood, countersinking a second diameter hole in said first piece of wood, inserting a one-piece wood rivet into the first diameter hole into the first piece of wood, deforming the head of the one-piece wood rivet such that the head occupies the countersunk bore, boring a hole into and through the second piece of wood, affixing a nut capable of receiving the threads of the wood rivet into the hole of the second piece of wood, and, threading the one-piece wood rivet into the nut adjustably securing the first piece of wood relative to the second piece of wood. An additional step of flaring the mouth of the nut so as restrain the nut against translational (axial) movement within the second piece of wood may be added to the process steps set forth above.

The invention has been particularly and specifically described by way of example only and those skilled in the art will recognize that many modifications and/or changes may be made to the foregoing without departing from the spirit and scope of the appended claims.

What is claimed is:

1. An adjustable threshold assembly comprising a substrate and a base member; said substrate includes a bore therethrough and a homogeneously formed rivet residing in said bore; said rivet includes an upper portion and a lower portion; said upper portion includes a flange and a lip; said lip of said upper potion of said rivet being in the shape of at of a cone and includes a slot therein for engaging screw driver; said lower portion of includes threads on the exterior thereof; said rivet being rotatable within said bore but not moveable axially within said bore; said base member includes a bore therethrough and a nut residing within the length of said bore, said nut includes external protrusions for affixing said nut to said base member; and, said nut includes threads which mate with said threads on said homogeneously formed rivet.

2. An adjustable threshold assembly as claimed in claim 1 wherein said substrate and said base are wood.

3. An adjustable threshold assembly as claimed in claim 1 wherein said rivet engages said substrate.

4. An adjustable threshold assembly as claimed in claim 3 wherein said rivet compresses said substrate such that rotation of said rivet within said bore of said substrate is allowable.

5. An adjustable threshold assembly as claimed in claim 4 wherein said nut is a t-nut pressed into said base member.

6. An adjustable threshold assembly as claimed in claim 5 wherein said nut includes a flared mouth end portion for receiving said threaded rivet.

7. An adjustable threshold assembly as claimed in claim 1 wherein said nut includes a flared end portion.

8. An adjustable threshold assembly as claimed in claim 1 wherein said substrate is metal.

9. An adjustable threshold assembly as claimed in claim 1 wherein said substrate is plastic.

10. An adjustable threshold assembly as claimed in claim 1 wherein said substrate is an engineered material selected from the group of metals, plastics, polymeric material, plywood, particle board and wafer board covered with a veneer.

* * * * *